US006799587B2

(12) United States Patent
Marshall et al.

(10) Patent No.: US 6,799,587 B2
(45) Date of Patent: Oct. 5, 2004

(54) APPARATUS FOR CONTAMINANT REMOVAL USING NATURAL CONVECTION FLOW AND CHANGES IN SOLUBILITY CONCENTRATIONS BY TEMPERATURE

(75) Inventors: Mary C. Marshall, San Antonio, TX (US); John G. Franjione, Attleboro, MA (US); Christopher J. Freitas, San Antonio, TX (US); William T. Roberds, San Antonio, TX (US); Gordon D. Pollard, Atascosa, TX (US); Jill Blake, Houston, TX (US)

(73) Assignee: Southwest Research Institute, San Antonio, TX (US)

( * ) Notice: Subject to any disclaimer, the term of this patent is extended or adjusted under 35 U.S.C. 154(b) by 218 days.

(21) Appl. No.: 10/085,358

(22) Filed: Feb. 28, 2002

(65) Prior Publication Data

US 2003/0056813 A1 Mar. 27, 2003

Related U.S. Application Data

(60) Continuation-in-part of application No. 08/674,702, filed on Jul. 8, 1996, now Pat. No. 6,165,282, which is a continuation-in-part of application No. 08/348,035, filed on Dec. 1, 1994, now Pat. No. 5,533,538, which is a division of application No. 07/906,557, filed on Jun. 30, 1992, now Pat. No. 5,401,322.

(51) Int. Cl.[7] ..... B08B 3/04

(52) U.S. Cl. ..... 134/60; 134/105; 134/106; 134/108; 134/135; 134/182; 68/18 C

(58) Field of Search ..... 134/60, 105, 106, 134/108, 135, 182, 200; 68/18 C

(56) References Cited

U.S. PATENT DOCUMENTS

| | | | | |
|---|---|---|---|---|
| 1,875,937 A | | 9/1932 | Savage | |
| 2,123,439 A | | 7/1938 | Savage | |
| 2,421,753 A | * | 6/1947 | Joyce | 62/373 |
| 2,577,359 A | * | 12/1951 | Phipps | 62/285 |
| 3,111,952 A | | 11/1963 | Roehl | |
| 3,663,293 A | | 5/1972 | Surprenant et al. | |
| 3,723,071 A | * | 3/1973 | Brown | 422/142 |
| 3,868,326 A | | 2/1975 | Talley, Jr. | |
| 4,302,273 A | | 11/1981 | Howard, Jr. | |
| 4,322,252 A | | 3/1982 | Plumb | |
| 4,405,219 A | * | 9/1983 | Yasuda et al. | 353/37 |
| 4,594,164 A | | 6/1986 | Titmas | |
| 4,764,317 A | | 8/1988 | Anderson et al. | |
| 4,792,408 A | | 12/1988 | Titmas | |
| 4,810,264 A | | 3/1989 | Dewitz | |
| 4,944,837 A | * | 7/1990 | Nishikawa et al. | 216/41 |
| 5,013,366 A | * | 5/1991 | Jackson et al. | 134/1 |
| 5,254,598 A | | 10/1993 | Schlameus et al. | |
| 5,339,844 A | * | 8/1994 | Stanford et al. | 134/107 |

(List continued on next page.)

FOREIGN PATENT DOCUMENTS

| | | | |
|---|---|---|---|
| AU | A-48290/96 | | 2/1997 |
| AU | 9648290 A | | 10/2002 |
| EP | 0333946 A1 | | 9/1989 |
| EP | 0397826 B1 | | 12/1992 |
| JP | 9-232271 | * | 9/1997 |
| JP | 10-209101 | * | 8/1998 |
| JP | 2001203180 | | 7/2001 |
| SU | 1476174 A1 | | 4/1989 |

*Primary Examiner*—Frankie L. Stinson
(74) *Attorney, Agent, or Firm*—Paula D. Morris & Associates, P.C.

(57) ABSTRACT

An apparatus comprising multiple heating, cooling, and/or cleaning zones. The apparatus produces a jet flow of solvent/cleaning fluid onto an article to be cleaned without the need for a pump or compressor. The jet flow provides more effective contaminant removal. The multiple zones result in increased residence time for increased efficiency in separating the solubilized contaminant from the solvent/cleaning fluid.

41 Claims, 4 Drawing Sheets

U.S. PATENT DOCUMENTS 5,348,803 A 9/1994 Schlameus et al.
5,355,901 A * 10/1994 Mielnik et al. ..... 134/105
5,360,976 A 11/1994 Young et al.
5,377,705 A * 1/1995 Smith et al. ..... 134/95.3
5,401,322 A 3/1995 Marshall
5,412,958 A * 5/1995 Iliff et al. ..... 68/5 C
5,463,220 A 10/1995 Young et al.
5,467,492 A * 11/1995 Chao et al. ..... 8/159
5,509,431 A * 4/1996 Smith et al. ..... 134/95.1
5,526,834 A * 6/1996 Mielnik et al. ..... 134/105
5,533,538 A 7/1996 Marshall
5,651,276 A * 7/1997 Purer et al. ..... 68/5 C
5,784,905 A * 7/1998 Townsend et al. ..... 68/13 R
5,822,818 A * 10/1998 Chao et al. ..... 8/158
5,858,107 A * 1/1999 Chao et al. ..... 134/1
5,881,577 A * 3/1999 Sauer et al. ..... 239/136
5,904,737 A * 5/1999 Preston et al. ..... 8/158
5,925,192 A * 7/1999 Purer et al. ..... 134/10
5,943,721 A * 8/1999 Lerette et al. ..... 8/158
5,970,554 A * 10/1999 Shore et al. ..... 8/158
6,165,282 A 12/2000 Marshall et al.
6,314,601 B1 11/2001 McClain et al.

* cited by examiner

APPARATUS FOR CONTAMINANT REMOVAL USING NATURAL CONVECTION FLOW AND CHANGES IN SOLUBILITY CONCENTRATIONS BY TEMPERATURE

PRIORITY INFORMATION

The present application is a continuation-in-part of application Ser. No. 08/674,702, filed Jul. 8, 1996, now U.S. Pat. No. 6,165,282, which was a continuation-in-part of application Ser. No. 08/348,035, filed Dec. 1, 1994, now U.S. Pat. No. 5,533,538, which was a divisional of application Ser. No. 07/906,557 filed Jun. 30, 1992, now U.S. Pat. No. 5,401,322.

GOVERNMENT RIGHTS

The U.S. Government has a paid-up license in this invention and the right in limited circumstances to require the patent owner to license others on reasonable terms as provided for by the terms of Contract No. F33615-95-D-5615 awarded by the Department of the Air Force.

BACKGROUND

1. Field of the Invention

The invention relates to methods and apparatus for cleaning articles using supercritical and/or near-supercritical fluids. In particular, the present invention relates to using differences in contaminant solubility and solvent density at various temperatures and/or pressures to effect cleaning action, to influence solvent and/or contaminant movement in the cleaning apparatus, and to facilitate the concentration of contaminants within the cleaning apparatus and their subsequent removal. Even more particularly, the invention relates to an apparatus comprising multiple heating, cooling, and/or cleaning zones, which result in a jet flow of solvent/cleaning fluid onto the article to be cleaned without the need for a pump or compressor. The jet flow provides more effective contaminant removal, and the multiple zones also result in increased residence time for increased efficiency in separating the contaminant from the solvent/cleaning fluid.

2. Background of the Invention

Solvents commonly are used to remove organic and inorganic contaminants from articles. The contaminated article to be cleaned is contacted with the solvent to solubilize and remove the contaminant. In a vapor degreaser, subsequent evaporation of the solvent separates the solvent and the contaminant, and the solvent vapors are redirected to the article to further clean it. The contaminant typically is concentrated in the evaporation step, removed as a precipitate, as a separate liquid phase, or as a concentrated solution in the original solvent.

Grease may be removed from the surface of metal castings and other nonabsorbent bodies by means of solvents, while contaminants collect in the bottom of the apparatus and are drawn off from time to time through a valve. One of the drawbacks of this type of cleaning process is that the cooling surfaces have a tendency to also condense water out of the atmosphere in addition to cooling and condensing the solvent. This condensed water then becomes associated with the solvent and comes into contact with the metal parts of the cleaning apparatus and with the article being cleaned.

The problem of condensed water with the solvent may be overcome by first contacting the atmosphere with condensing surfaces at a temperature above the dew point of the atmosphere in which the operation is being carried out, but substantially below the condensing temperature of the solvent. The condensed solvent is drawn off for use in the cleaning process, while the remaining vapors are brought into contact with still cooler surfaces (cooler than the dew point) to condense out the water so it can be removed. Alternatively, the article itself may be cooled. Vapors of a solvent may be generated from a liquid sump and a desired level of solvent vapor established by adjusting the temperature of the condenser. A contaminated cold article is introduced into the solvent vapors, thereby causing the vapor to condense on the article. Condensate containing the contaminant falls from the article into the sump, and the article is removed from the solvent vapor when its temperature reaches the solvent vapor temperature (thus precluding further solvent condensation on the article).

Cleaning Using Supercritical Fluids

In an effort to improve on vapor degreasing methods, supercritical (and near-supercritical) fluids have been used as solvents to clean contaminants from articles. NASA Tech Brief MFS-29611 (December 1990), describes the use of supercritical $CO_2$ as an alternative for hydrocarbon solvents conventionally used for washing organic and inorganic contaminants from the surface of metal parts.

In a typical supercritical fluid cleaning process, the part to be cleaned is contacted with a supercritical fluid. The supercritical fluid, containing solubilized contaminants removed them from the part, flows to a zone of lower pressure through an expansion valve. The resulting depressurization causes the state of the solvent fluid to change from supercritical to subcritical, resulting in separation of the solute (that is, the contaminant) from the solvent. Relieved of its burden of contaminant, the cleaned solvent fluid is compressed back to a supercritical state and again brought into contact with the part if further cleaning is desired.

Alternately, the article to be cleaned, such as a silicon wafer is placed in an atmosphere of supercritical carbon dioxide which contacts the wafer to solubilize the contaminant. After cleaning is complete, carbon dioxide is cooled to below its supercritical temperature (i.e. the system pressure is reduced and the carbon dioxide attains equilibrium between the liquid and gas phases) before removal of the cleaned wafer from the apparatus.

While effective, the foregoing processes are relatively inefficient because of the energy consumed in each pressurization-depressurization cycle. Further energy losses and increases in equipment complexity are associated with moving the solvent through the apparatus in both supercritical and subcritical states.

SUMMARY OF THE INVENTION

An apparatus for removing contaminants from an article to be cleaned in a pressure vessel comprising;

- a first zone and a second zone separated by a first thermally insulated baffle, said first zone comprising at least a first heating element adapted to direct a fluid from said first zone to a second zone;
- a third zone separated from said second zone by a second thermally insulated baffle, said second zone comprising at least a second heating element adapted to direct said fluid from said second zone to said third zone;
- said third zone being separated from a fourth zone by a third thermally insulated baffle, said third zone being adapted to retain said article to be cleaned and comprising at least a third heating element adapted to direct said fluid from said third zone to said fourth zone, said third zone further comprising at least one cooling element and at least a first static baffle adapted to divert at least a portion of said fluid being directed from said fourth zone onto said article to be cleaned, producing a natural convective fluid flow at a rate effective to remove contaminants from said article to be cleaned.

DETAILED DESCRIPTION OF THE INVENTION

Figure 1:
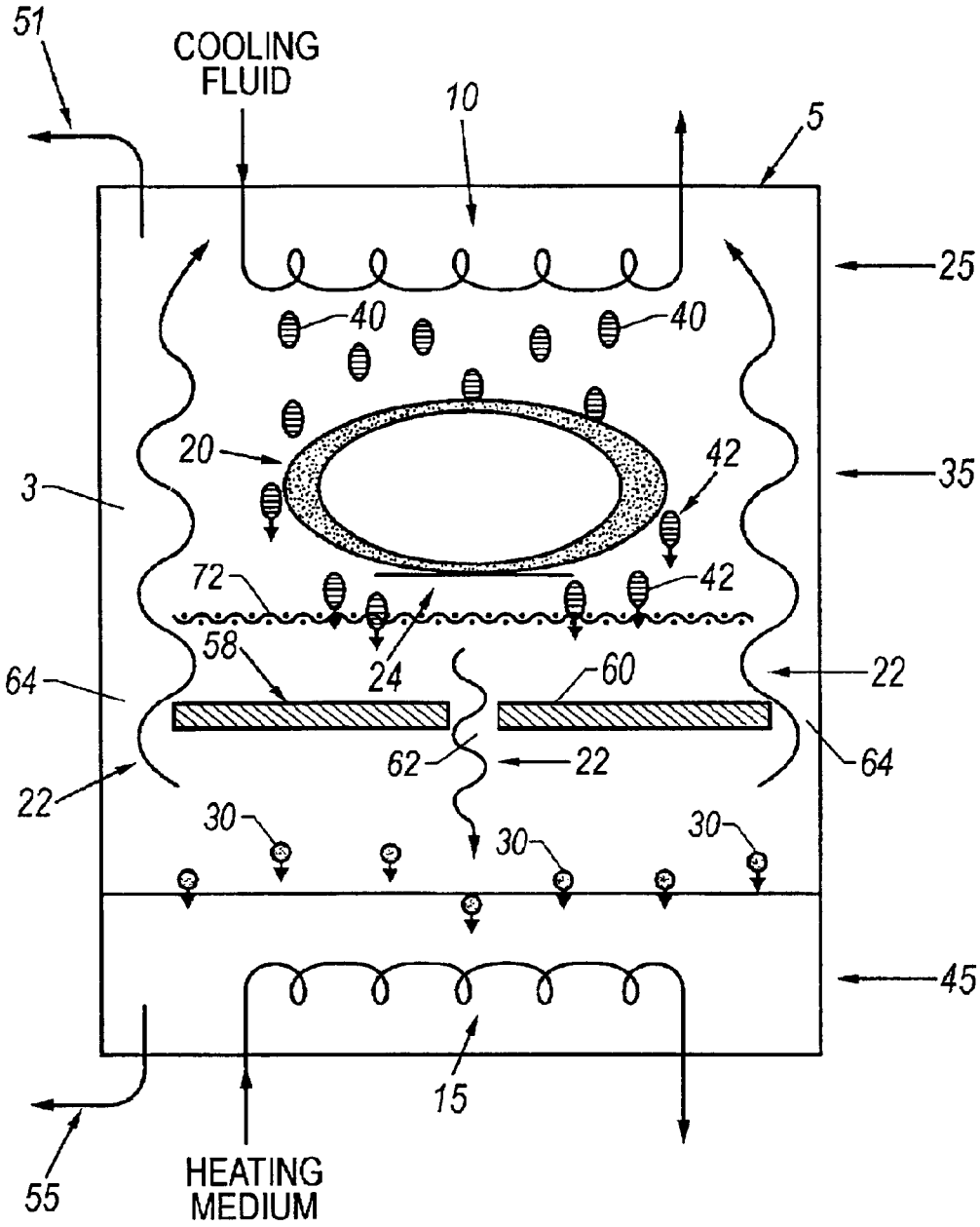
FIG. 1 schematically illustrates one embodiment of the present invention with cooling element(s) above the cleaned part and heating element(s) below the cleaned part.

The present invention provides apparatuses and processes which avoid or reduce shortcomings noted above by keeping the solvent/cleaning fluid in a supercritical or near-supercritical state in a pressure vessel throughout the cleaning and contaminant removal process. The process is based upon natural convection for using the supercritical or near-supercritical fluid, preferably carbon dioxide, as a cleaner without continuously compressing the fluid and without the need to pump it past the article to be cleaned in order to solubilize all of the contaminant present on the article. The solubility temperature dependence at constant pressure and the resultant natural convection currents are thus exploited to clean the part and to regenerate the carbon dioxide within a single vessel. In this way, the usage of the cleaning fluid is independent of cleaning time (it is based solely on the amount of fluid used during parts introduction and removal), and energy usage is less than other cleaning devices since only heat exchangers are employed without a compressor.

Processes

The article to be cleaned preferably is placed on a support within the pressure vessel and contacted with a supercritical or near supercritical fluid in which the contaminant is soluble to solubilize the contaminant at a first supercritical or near supercritical temperature. For pressure regions where the solubility decreases with increasing temperature, the fluid is heated for purification. For pressure regions where the solubility decreases with decreasing temperature, the fluid is cooled for regeneration/recirculation/purification.

At pressures near the critical pressure where the solubility of a compound in supercritical carbon dioxide SC—$CO_2$ decreases with increasing temperature, the density of the SC—$CO_2$ decreases with increasing temperature at a given pressure. Thus, at isobaric conditions, the contaminant is solubilized in the cold region. The cold fluid with the contaminant then falls by gravity to a bottom heat exchanger at which point phase separation occurs (i.e., the contaminant separates from the hot, low saturation concentration carbon dioxide). The hot SC—$CO_2$ rises since it is less dense, and the contaminant pools at the vessel floor since the contaminant (oils and greases) is more dense than SC—$CO_2$. The solubility temperature dependence at constant pressure and the resultant natural convection currents are thus exploited to clean the part and regenerate the carbon dioxide within a single vessel.

The first and second supercritical or near-supercritical temperatures may generally be any two supercritical or near-supercritical temperatures as long as the solubility of the liquid is lower at the second temperature. Preferably, these temperatures are selected to facilitate dissolving of the contaminants at the first supercritical or near-supercritical temperature and separation of the contaminants at the second supercritical or near-supercritical temperature. In addition, it is generally preferred that that second temperature be selected to minimize separation of the contaminant on the part as it is removed at the end of the cleaning process. This usually means that a low solubility of the contaminant at the second temperature is desired. Preferably, the first and second temperatures will be supercritical with respect to the fluid used.

The improved cleaning apparatus of the present invention is generally operated at a substantially constant pressure which is selected along with the temperature to provide the proper differences in contaminant solubility between the first and second supercritical temperatures.

The supercritical or near-supercritical fluid used in the apparatus of the present invention is generally selected for its ability to dissolve the contaminant to be removed. Suitable supercritical or near-supercritical fluids include inert gases, hydrocarbons, fluorocarbons and carbon dioxide. Preferably, the supercritical or near-supercritical fluid is selected from the group consisting of carbon dioxide and $C_1$ to $C_{10}$ hydrocarbons. The cleaning ability of the fluid may be enhanced by the addition of at least one material selected from the group consisting of cosolvents, entrainers, adjuvants and surfactants.

In one embodiment, a first portion of the fluid within the pressure vessel is heated and a second portion of the fluid within the pressure vessel is cooled. The heated portion of the fluid is separated from the cooled portion of the fluid using one or more insulated baffle(s) within the pressure vessel for maintaining at least one temperature difference between zones in the fluid to solubilize contaminant on the article and separate the contaminant from the fluid, and facilitate convective fluid flow within the pressure vessel, decreasing the density of the fluid such that the density change will cause the heated fluid to flow past the article. The insulated baffle(s) direct at least a portion of the convective fluid flow toward the article to be cleaned to remove contaminants from the article. Next, at substantially constant pressure, the solubility of the fluid with respect to the contaminant is reduced. Once the contaminant containing fluid has been cooled or heated to a second supercritical or near supercritical temperature to reduce the solubility of the contaminant in the fluid and to precipitate at least a portion of the solubilized contaminant, the precipitated contaminant is recovered. "Precipitate" as used herein refers to the amount of contaminant above the solubility limit of the fluid that separates in a gas, liquid or solid form, from the fluid as its solubility is lowered. The precipitate is then removed either batchwise or continuously.

Figure 5:
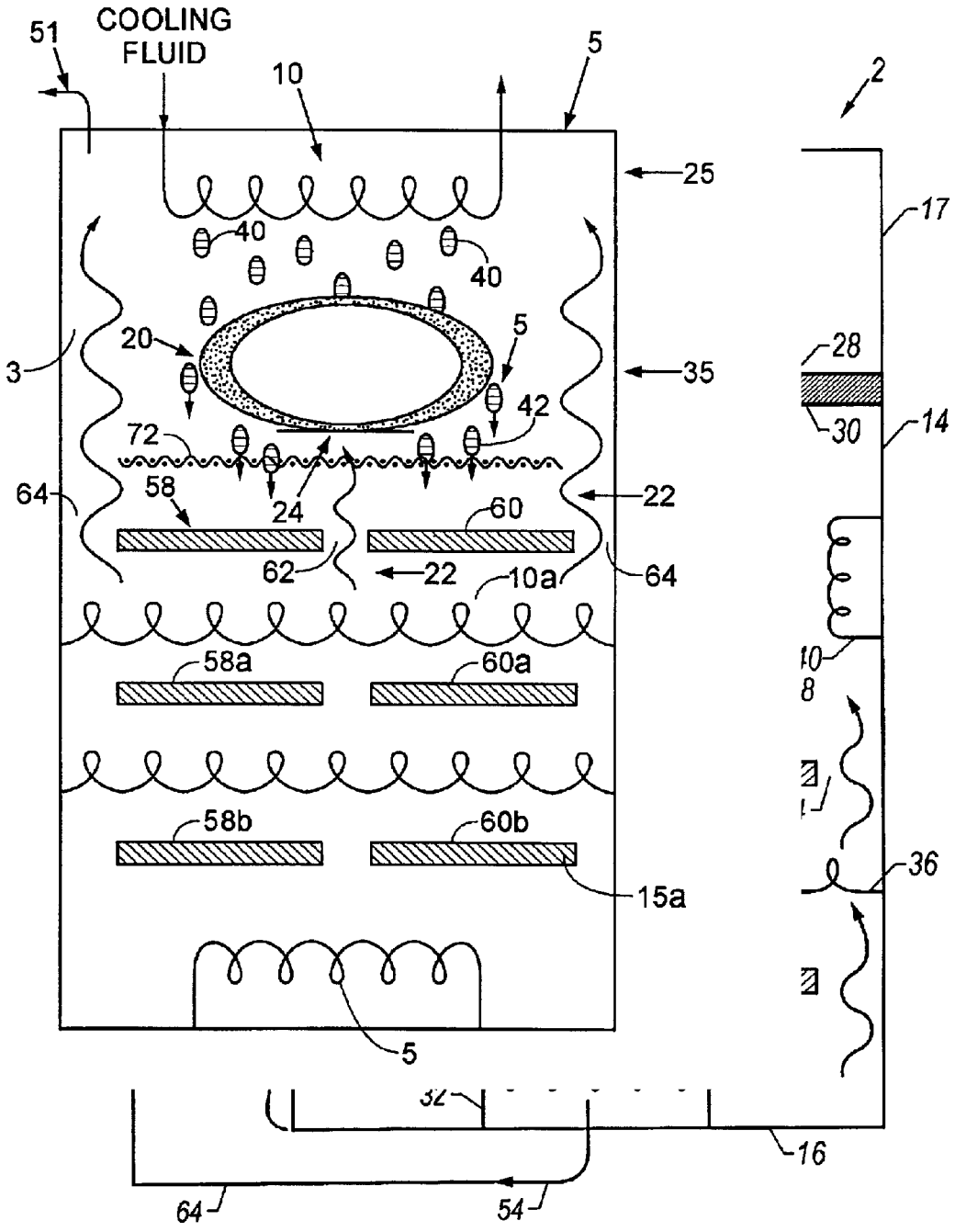
FIG. 5 schematically illustrates another alternative embodiment of the present invention with multiple zones and heating and cooling elements positioned within given zones.

Another embodiment uses multiple zones to increase contaminant removal by increasing the velocity of the fluid contacting the article to be cleaned, and to increase separation efficiency of the contaminant by increasing residence time. An example of an apparatus for use in this embodiment is described in detail with reference to FIG. 5. The apparatus in FIG. 5 is for use when, at approximately constant pressure, the solubility of the contaminant increases with decreasing temperature. Referring to FIG. 5, a first portion of the fluid within the pressure vessel is heated in a first zone 4 and a second portion of the fluid within the pressure vessel is cooled within at least the fourth zone 10. The heated portion of the fluid is separated from the cooled portion of the fluid using one or more insulated baffle(s) 12*a, b, c* within the pressure vessel for maintaining at least one temperature difference between zones in the fluid to isolate temperature regions within the pressure vessel, and to decrease the density of the fluid such that the density change will cause the heated fluid to flow past the article toward the cooling zone. A first insulated baffle 12*a* directs at least a portion of the convective fluid flow 34*a* along an annular passage adjacent to the outer wall of the pressure vessel from a first zone 4 to a second zone 6 comprising a second heating means. The fluid in the second zone 6 is further heated and a second insulated baffle 12*b* directs at least a portion of the convective fluid flow 34*a* along an annular passage adjacent to the outer wall of the pressure vessel from the second zone 6 toward a third zone 8 containing the article to be cleaned 44. The convective fluid flow 34*b* encounters a third heating element 38 and flows toward a fourth zone 10 containing a cooling element 42. At substantially constant pressure, the solubility of the fluid with respect to the contaminant is increased by cooling in the fourth zone 10. Preferably, the third baffle has a substantially concave surface adjacent to the gap in the fourth zone 10 in order to enable a slight and temporal pressure buildup in the fourth zone 10 before the cooled fluid "burps" back into the third zone 8 along a path 60 and is directed onto the article to be cleaned 44. The pressure buildup and burping action creates a temporal and relatively high velocity cooled stream which readily solubilizes contaminant on the article to be cleaned 44. A cooling element 40 continues to cool the stream and to draw the contaminant containing stream 34*e* downward through heated second zone 6 and first zone 4. Once the contaminant solubilized fluid 34*e* is heated to a second supercritical or near supercritical temperature to reduce the solubility of the contaminant in the fluid and to precipitate at least a portion of the solubilized contaminant, the precipitated contaminant flows to a recovery element 54.

The foregoing process uses a fluid which exhibits increased contaminant solubility with decreased temperature. Persons of ordinary skill in the art will be able to alter this embodiment to use a supercritical or near-supercritical fluid having a decreased solubility for contaminants with decreased temperature.

Another method of the present invention involves concentrating contaminants removed from an article to be cleaned using a fluid within a pressure vessel. The method comprises removing contaminants from the article to be cleaned by the above method and then concentrating by separation at least a portion of the removed contaminants from the fluid by heating or cooling the fluid at a location within the pressure vessel and spaced apart from the article to be cleaned. Contaminants removed from an article and concentrated as above may be superconcentrated within a pressure vessel. Methods to accomplish this comprise directing at least a portion of the convective fluid flow comprising precipitated contaminants toward a separator, preferably using an insulated baffle. The separator comprises, for example, a separatory funnel, a screen separator (or filter) and/or a cyclone separator within the pressure vessel. At least a portion of the precipitated contaminants are superconcentrated by separation within the separatory funnel, the screen separator and/or the cyclone separator.

In a preferred embodiment, where the solvent/cleaning fluid is carbon dioxide, at pressures near the critical pressure, the solubility of a compound in the carbon dioxide decreases with increasing temperature. Also, the density of the carbon dioxide decreases with increasing temperature at a given pressure. Thus, at isobaric conditions, the contaminant is solubilized in the cold region. The cold carbon dioxide with the contaminant falls away from the part, preferably by gravity to a bottom heat exchanger at which point phase separation occurs (i.e., the contaminant separates from the hot, lower saturation concentration fluid). The hot carbon dioxide rises since it is less dense, and the contaminant pools, preferably at the vessel floor, since the contaminant is more dense than the carbon dioxide. Baffles have been added in the column, preferably a vertical column, to effect greater temperature differentials and greater contaminant saturation point differentials between hot and cold zones.

The Apparatus

The pressure vessel used in the foregoing methods comprises at least one sealable access to the vessel interior, such as a door, lid, pressure lock, hatch, valve, etc., preferably a TubeTurns® closure for safety and Grayloc connectors over flanges. Note that a pressure lock may itself comprise a pressure vessel. The sealable access may also comprise one or more ports to introduce and/or remove articles to be cleaned, to remove (and if desired, recover) concentrated contaminants (including contaminated solvents), and to replenish the solvent as needed.

A preferred design is effective to remove fluid contaminants and particulates, preferably having a terminal settling velocity in the Stoke's law region no greater than the equivalent of approximately 500 $\mu$m in diameter stainless steel particle. This design may be used with any embodiment of the apparatus, or with conventional supercritical fluid extractors, but will be described with reference to FIG. 5. The design includes a bypass line 64, a low flow rate pump 66, and a filter 68. The low flow rate pump 66 is adapted to generate flow rates up to 126.18 $cm^3/s$ (or 2 gpm) for the 11-inch internal diameter vessel design. The location of bypass line 64 is not critical as long as the recovery element 54 is adapted to remove precipitate from the system and the entry point 70 of the regenerated fluid is located so as to not interfere with functioning of the system. The piston driven low flow rate pump 66 draws fluid and particles out of the bottom of the device and pumps the fluid through the filter 68, and then injects it back into the top of the cold upper chamber. The filter preferably is a 5 $\mu$m filter located in the bypass line 64 and removes particulates from the fluid as it flows towards the upper chamber of the device.

Solubilized contaminants are concentrated and recovered through use of heating elements and/or cooling elements within the pressure vessel by a heat exchanger cooperating with the vessel walls, or by other known heating or cooling means. The heating and/or cooling means cause temperature changes in a solvent fluid which change contaminant solubility in the fluid. Even during contaminant recovery in the above improved cleaner, however, the solvent fluid remains in a supercritical or near-supercritical state. Consequently, the energy consumption is reduced (and efficiency is increased) over existing cleaners in which the solvent must be heated to account for enthalpy losses upon depressurization and compression to recycle the solvent and to use it in the supercritical state.

In preferred embodiments of the improved cleaner, mechanical pumps are virtually unnecessary (initial pressurization and replacement of solvent fluid during operation can simply be accomplished by heating the cleaner/solvent fluid, preferably liquid carbon dioxide) because bulk-flow and micro-flow convection currents provide the desired fluid circulation. Additionally, because of the large density changes with low temperature differences and the low viscosity, supercritical fluids can move very quickly in response to relatively small temperature differences in different fluid zones. Such rapid solvent fluid movements, however, are detrimental to creating relatively large temperature differences within the solvent fluid necessary to effect large solubility differences within the supercritical fluid thereby diminishing the internal cleaning/recycling functionality of the invention. The rapid movement of the supercritical fluid past a heat exchanger surface reduces the amount of heat transfer; greater temperature differentials between the fluid and heat exchanger surface aggravate the problem. A solution is to increase the effective area for heat transfer by providing more contact time with the supercritical fluid by altering the fluid flow patterns preferably through use of insulated baffle means.

In certain preferred embodiments, heat pumps may be used to maintain a desired temperature differential between heating zones (containing, for example, one or more heating element) which are spaced apart from cooling zones (containing, for example, one or more cooling element). In such cases, the cooling element would comprise, for example, the heat pump evaporator coils, while the heating element would comprise, for example, the heat pump condenser coils. Auxiliary heating and cooling will be needed since 100% thermal efficiency cannot be achieved. The heating and cooling element(s) may also include passive radiators thermally coupled to ambient fluids such as air (the stainless steel pressure vessel walls conduct large quantities of heat from the supercritical fluid necessitating insulation of the hot zone to achieve improved temperature control). Thermoelectric devices such as resistance heaters (for heating) and Peltier devices (for heating and/or cooling) have been successfully employed in the experimental operation of this invention. Peltier devices in particular may be employed to establish or augment a desired temperature difference across a baffle, thus providing a functional equivalent of insulated baffle means. For purposes of the present invention, insulated baffle means comprise such combinations of Peltier devices and baffles. Hence, convective fluid flow in improved cleaners of the present invention may be easily reversed in whole or in part by reversal of current flow in one or more Peltier junctions within the pressure vessel provided the proper configuration for exploiting the gravitational forces is used; such real-time modulations may be beneficial for localized supercritical fluid currents to dislodge, relocate, or separate contaminants from the part and out of the solvent.

Control of either bulk or micro convective fluid movements in the above improved cleaner is preferably facilitated by insulated baffle(s), (to direct or channel the fluid stream flow). One or more insulated baffles generally separate portions of moving fluid streams from portions of other moving fluid streams, wherein a temperature difference exists between the separated portions. The insulated baffle(s) should be such that the heat transfer by conduction across the baffle is much less than the heat transfer by convection of the supercritical fluid moving between the hot and cold zones. This criterion is necessary in order to encourage the desired mass transfer (i.e., movement of clean supercritical fluid to the part and movement of contaminants from the part) while also providing a large temperature difference between fluid zones to effect separation of the contaminant from the supercritical fluid. Note that insulated baffles separate only portions of fluid streams. That is, fluid stream separation is not total but merely sufficient to maintain a desired temperature difference between zones comprising fluid streams or flows, sometimes called solvent fluid streams (preferably at least partly supercritical), to facilitate convective fluid flow and/or to achieve or maintain desired conditions of solubility or insolubility of one or more contaminants in a solvent fluid.

The insulated baffle(s) comprise at least one space-occupying rigid or semi-rigid baffle structure which in use separates portions of at least two moving fluid streams comprising supercritical and/or near supercritical fluid, wherein a temperature difference exists between portions of at least two of the separated fluid streams. In practice, the insulated baffle may comprise, for example, structures having substantially planar and/or at least partially curved external surfaces and incorporating one or more evacuated spaces and/or other thermal insulators substantially in a thermal path between the external surfaces (and/or portions thereof) to restrict convective heat transfer so that discrete temperature (and hence solubility) zones may form in the fluid. The thermal insulators may comprise, for example, rubber, plastic and/or fibrous materials having low thermal conductivity relative to solvent fluids intended for use.

The insulated baffle is primarily designed to provide the necessary temperature difference between fluid zones for effective cleaning and solvent replenishing. The insulated baffle is also used to enhance cleaning action by, for example, directing the convective flow of a stream of relatively clean solvent fluid to an article to be cleaned, possibly increasing flow velocity by decreasing stream cross-sectional area and/or by other means. Articles to be cleaned preferably rest on a support, preferably a stationary or adjustable shelf, or they may be rotated and/or translated during cleaning by, for example, a robotic manipulator. The size and/or location of holes or ports in individual baffles and/or the size and configuration of gaps between baffles and/or between pressure vessel walls and baffles, as well as individual baffle surface contours and/or orientations with respect to a pressure vessel, may be individually or collectively adjustable (as by closed loop control systems and/or by thermally active elements such as, for example, bimetallic elements analogous to those within a thermostat). Such adjustments preferably are made, for example, to facilitate modification of convective fluid flow velocities and/or patterns, and/or contaminant dissolving power of solvent fluid, and/or contaminant separation from solvent fluid. Such baffle adjustments may be made in substantially real time, for example, to either accentuate or attenuate convective fluid flow characteristics to achieve, for example, improved cleaning action and/or improved contaminant concentration and/or recovery functions.

Static baffles are also useful for the economical and highly reliable operation of the cleaner. Different designs provide different cleaning performance benefits. For example, a baffle with only a center hole effects mass transfer through oscillating, pulsed flow in which the hot fluid surges through the hole, mixes rapidly with the cold fluid (decreasing the contaminant concentration in the cold fluid), and then the cold fluid surges into the hot zone with the cold fluid plume transferring the contaminant to the separation zone. Alternately, a baffle with an outer open ring and center hole permits, for example, hot fluid to flow though the outer ring and cold fluid downward through the center hole; thus causing first-in first-out mass transfer.

An insulated baffle (whether adjustable or non-adjustable) also may be used to facilitate removal of contaminants from contaminated fluid by, for example, directing the flow of a stream of fluid containing one or more dissolved contaminants toward a heat source or sink (that is, heating element or cooling element, respectively) which will raise or lower the temperature of the fluid sufficiently to cause the desired contaminant to separate from the fluid. Precipitated contaminants may, in turn, be allowed to settle out of the stream by increasing stream cross-sectional area and slowing stream velocity, or they may be superconcentrated using, for example, a screen separator, demister, impinger, separatory funnel, maze of tortuous return flow channels, or cyclone as the stream is directed to travel a curved path by insulated baffle. These devices could be mounted directly to the baffle, for example in the first-in, first-out baffle configuration a mechanical filter could be mounted to the ring opening to collect particulates (for example, precipitated contaminant, inorganic materials, dust, or metal shavings) or coalescing liquid contaminant droplets before returning the clean hot fluid to the cold zone. Another configuration is to have a side piping to the main cleaning chamber in which a heat exchanger is located. The supercritical fluid would move through this side piping via natural convection currents. The filters, impingers, or cyclone could be located within this piping to help segregate the contaminants from the supercritical fluid (much like the behavior of a steam trap in a pipe flowing steam). Contaminants which have been concentrated by separation and/or those which have been superconcentrated by one or more of the above methods are intermittently or continuously removed from the cleaning apparatus via a recovery element (such as, for example, a sump drain valve or a pressure lock for removing semisolid contaminants) positioned within a pressure vessel port to recover the contaminants.

Thus, preferred embodiments of the invention include an apparatus for removing contaminants from an article to be cleaned, the apparatus comprising a pressure vessel and a support within the pressure vessel for supporting the article to be cleaned. Heating element(s) within the pressure vessel facilitate convective flow of a solvent fluid within the pressure vessel, and cooling element(s) within the pressure vessel (which are spaced apart from the heating element(s) also facilitate convective flow of a solvent fluid within the pressure vessel. Finally, insulated baffle(s) within the pressure vessel are positioned between the heating element(s) and the cooling element(s) for maintaining at least one temperature difference between zones in a solvent fluid within the pressure vessel.

Note that first and second heating element(s) (or a plurality of heating elements) spaced apart within the pressure vessel, and/or first and second cooling element(s) (or a plurality of heating elements) spaced apart within the pressure vessel and apart from the heating element(s), may also be used to facilitate convective flow of a solvent fluid within the pressure vessel. Note also that heating and/or cooling element(s) within the pressure vessel and spaced apart from any other heating or cooling element(s) may be used to facilitate separation of contaminants from a fluid within the pressure vessel. In certain embodiments of the improved cleaner, heating element(s) and/or cooling element(s) may serve the dual functions of facilitating both convective fluid flow and separation of contaminants from a solvent or cleaning fluid.

In any of the above embodiments of the present invention, the insulated baffle(s) may have an annular gap and a substantially centered hole. Certain embodiment(s) comprise at least one insulated baffle having a peripheral hole. The insulated baffle also may comprise at least one adjustable baffle hole.

The embodiments of FIGS. 1–4 are described in the examples. Referring to FIG. 5, a pressure vessel 2 includes a first zone 4, a second zone 6, a third zone 8, and a fourth zone 10 separated within pressure vessel 2 by insulated baffle(s) 12*a, b, c*, spaced apart within pressure vessel 2. Persons of ordinary skill in the art will recognize that it is not absolutely essential for the zones to be located gravitationally above or below one another. For example, the zones may be oriented horizontally or diagonally, etc., to one another. In a preferred arrangement, fourth zone 10 is located gravitationally above third zone 8, third zone 8 is located gravitationally above second zone 6, and second zone 6 is located gravitationally above first zone 4. Pressure vessel 2 has a sidewall 14, which preferably is greater in length than bottom wall 16 or top wall 18. Although the pressure vessel 2 may have a variety of configurations, such as rectangular, elliptical, etc., a preferred configuration is cylindrical.

First and second insulated baffle elements 12*a*, 12*b* include a substantially centered hole 22*a* and an annular gap 24 positioned between the side wall 14 and the baffle elements 12*a*, 12*b*. The third insulated baffle element 12*c* extends horizontally from the inner wall 26 of the pressure vessel 2 having a substantially centered hole 22*b*. Each insulated baffle element has an upper surface 28 facing an upper zone and a lower surface 30 facing a lower zone.

The first zone 4 comprises at least a first heating element 32. Although the figures indicate that the preferred heating and cooling elements are actually within the pressure vessel, the elements may also be heat exchangers associated with the wall of the pressure vessel surrounding the respective zone. The first heating element 32 induces a natural convective flow 34*a* of the fluid gravitationally upwards to the second zone 6. The second zone 6 comprises a second heating element 36, preferably a heat exchanger. The third zone 8 comprises a third heating element 38 and a first cooling element 40. In a preferred embodiment, the third heating element 38 comprises a heat exchanger which inputs heat at one wall of the pressure vessel in the third zone, and the cooling element is a heat exchanger which removes heat or cools an opposed wall of the pressure vessel in the third zone 8, preferably substantially adjacent to the article to be cleaned 44. The third heating element 38 directs fluid flow 34*b* gravitationally upward via flow 58 into the fourth zone 10. A second cooling element 42, preferably a heat exchanger either associated with the wall 17 of the fourth zone or positioned along the top 18 of the pressure vessel 2.

In a preferred embodiment, the third baffle 12*c* comprises a central aperture 22*b* which comprises concave top surfaces 23 to return the cooled fluid in the fourth zone 10 to the third zone 8 via jet stream 60. The small opening 22*b* prolongs the residence time of the fluid in the fourth zone 10, thereby increasing the cooling of the fluid and the solubility potential of the contaminant in the fluid. The increased resistance created by the small opening 22*b* also increases the pressure at which fluid finally "burps" through the aperture 22*b*, producing a jet stream of the fluid onto the article to be cleaned 44. The increased velocity of the jet stream and the increased cooling of the fluid increases the efficiency of cleaning of the contaminant from the article to be cleaned 44.

The third zone 8 preferably contains a support element 46, which may be a separatory screen 48, supporting the article to be cleaned 44. Optionally, the third zone 8 contains a fourth static baffle 50 and a fifth static baffle 52. If present, the fourth static baffle 50 is positioned near the substantially central aperture 22*b* and is oriented to deflect the edge of the "plume" created by the "burping" of fluid through substantially central aperture 22*b* toward the article to be cleaned 44. If present, the fifth static baffle 52 is positioned near the substantially central aperture 62 in the second insulated baffle 12*b* to direct contaminant-containing fluid 34*e* downward through substantially central aperture 62 toward the second zone 6.

The first heating element 32 in a first zone 4 preferably heats the fluid to a supercritical or near supercritical temperature for that fluid. The second heating element 36 heats the fluid from the third zone 8 to begin removing contaminants. The third heating element 38 preferably increases the fluid temperature to increase the convection speeds and to direct the fluid past the article to be cleaned 44. The second cooling element 40 in the fourth zone preferably cools the fluid to a temperature effective to solubilize the contaminant present on the article to be cleaned 44 and to increase the rate of mass transfer by further increasing convection speeds. The first cooling element maintains the fluid at a temperature effective to solubilize the contaminant present on the article until the contaminant containing fluid exits the third zone, preferably via the aperture 62.

Where the fluid is carbon dioxide, the pressure is preferably 980 psig to about 1720 psig. The first heating element 32 heats the fluid to a temperature of from about 45 to 50° C.; the second heating element heats the fluid to a temperature of from about 40 to 45° C.; the third heating element heats the fluid to a temperature of from about 38 to about 40° C.; the second cooling element preferably cools the fluid to a temperature of from about 38 to 40° C.; and, the first cooling element cools the fluid to a temperature of from about 35 to 38° C. Cleaning can be accomodated in a matter of minutes depending on what is being cleaned and the design of the part introduction chamber. Cleaning time is defined as the time required for the mass fraction of contaminant in the cold zone to fall below some predetermined value. The following equation can be solved for t, yielding the cleaning time:

$$t^*=M_1/m\cdot ln((x_1^{sat}-x_2^{sat})/(x_1^*-x_2^{sat}))$$

where t*—cleaning time $x_1$—desired cold chamber mass fraction at the end of cleaning $M_1$—total mass of fluid in the cold chamber m—total mass flow rate between the chambers For example, if $x_1^{sat}=0.01$, $x_2^{sat}=0.0001$, and the desired mass fraction is 0.00015, the logarithmic term is equal to 5.29. The expression can be simplified to give:

$$t^*=5.29(p_1V_1c_p(T_2-T_1)/y)$$

where the above equation has been solved for m, and $M_1$ has been replaced by $p_1V_1$ (where $V_1$ is the volume of the cold chamber, and $p_1$ is the density of the fluid at the cold chamber temperature). Using temperatures from Table 1 as estimates for $T_1$ and $T_2$, the cleaning times can be estimated.

TABLE 2

HEAT INPUT RATE, COLD CHAMBER DENSITY, CHAMBER TEMPERATURE DIFFERENTIAL, AND ESTIMATED CLEANING TIMES

| $N_{Ra}$ X $10^{13}$ | q (W) | $\rho_{cold}$ (kg $m^{-3}$) | ΔT (° C.) | t* (min) |
|---|---|---|---|---|
| 12.4 | 623 | 605 | 18.5 | 52 |
| 4.1 | 280 | 328 | 20.3 | 69 |
| 1.8 | 182 | 249 | 21.0 | 83 |
| 4.1 (baffle at L/3) | 302 | 330 | 19.1 | 81 |

Cleaning times can be decreased if: (1) the cold chamber volume is reduced; (2) the temperature of the cold zone is increased (lower density); and/or (3) the rate of heat addition and removal is increased.

Where the cleaning/solvent fluid is carbon dioxide, it is important to use materials that are not damaged due to exposure to the pressurized carbon dioxide. In such an embodiment, the baffles, and other equipment, such as interior wiring, preferably are constructed from TEFLON®; insulation for electrical penetrators preferably are constructed from polyimide; actuators preferably are made of DELRIN®; a preferred adhesive for mounting switches, mechanical stops, and wiring is J. B. Weld available from J-B Weld Company in Sulfur Springs Tex., (a 2-part epoxy found in auto supply stores); preferred o-rings are made from 90-durometer buna-n (Parker compound n552-90), and must be replaced after severe stretching (typically after about a dozen cleaning cycles); diaphragm for the pressure transducer preferably is stainless steel or TEFLON®.

After the cleaning process is completed, the part must be removed from the vessel in a manner that minimizes separation of contaminant onto the part. Generally, this may be accomplished by precipitating contaminant on a heat transfer device while depressurizing the solvent fluid or by varying the rate of depressurization. In addition, when processing pressure-sensitive parts or electronic components, it is generally necessary to control both pressurization and depressurization rates to avoid damage to these parts or components.

EXAMPLES

The following examples are provided to further illustrate various embodiments of the present invention. Table 2 shows the solubility of naphthalene in supercritical ethylene.

TABLE 2

Solubility of Napthalene in Supercritical Ethylene

| Reduced Pressure | Reduced Temperature: 1.01 Solubility (g/L) | 1.12 Solubility (g/L) | 1.01 Approximate Density ($P_r$) | 1.12 Approximate Density ($P_r$) |
|---|---|---|---|---|
| 1.2 | 7.1 | 0.24 | 1.4 | 0.4 |
| 2.0 | 14 | 14 | 1.8 | 1.1 |
| 6.1 | 22 | 150 | 2.1 | 1.9 |

Example 1

The apparatus of this example is shown in FIG. 1 in which pressure vessel 5 comprises heating means 15, and cooling means 10, and insulated baffle means 58. Insulated baffle means 58, in turn, comprises a baffle 60 having a substantially centered hole 62 and an annular gap 64, the latter arising from its size and from its spatial relationship with pressure vessel 5. In the present embodiment, heating means 15 and cooling means 10 are shown as coils, but it is understood that any suitable heat transfer means may be used such as flat plates, trays or any other known heat transfer device. In vessel 5 there is the cooling zone 25, cleaning zone 35 and heating zone 45. Naphthalene contaminated part 20 is supported in cleaning zone 35 by support means 24 which is illustrated as a metal screen. Support means 24 may optionally comprise a robotic arm to enhance the exposure of part 20 to the various fluid flows through translation and/or rotation. In the embodiment shown, supercritical fluid 3 is ethylene.

In operation, the system is operated at 60.6 atm (reduced pressure of 1.2) with the cooling zone at 13° C. and the cleaning zone at a temperature between 13° C. and 44° C. At those temperatures, ethylene has a density of 0.305 g/cc and 0.087 g/cc, respectively. Consequently, as heating means 15 heats the supercritical ethylene in the heating zone to 44° C., it forms a less dense supercritical ethylene which rises toward the cooling zone as shown by arrows 22. Cooling means 10 cools the supercritical ethylene which increases its density to 0.305 g/cc and at the same time increases its solubility with respect to naphthalene to 7.1 g naphthalene/liter ethylene. The more dense supercritical ethylene now flows down as indicated by drops 40 to contact part 20 and solubilize some of the contaminant naphthalene. Drops 40 may loosen substantially insoluble particulate contaminants from part 20 and carry them down to be caught on separatory screen 72. As the naphthalene dissolved in supercritical ethylene 42 is heated up, its solubility with respect to naphthalene decreases to 0.24 g naphthalene/liter ethylene, thereby precipitating excess naphthalene 30. The precipitated naphthalene is far more dense than the fluid 3 and falls to the bottom of vessel 5. The naphthalene may be periodically or continuously removed from vessel 5 via contaminant purge means 55. For some contaminants or fluids it may be necessary to use separation means (not shown) such as, for example, a separatory funnel to force settling of the contaminant in the bottom of vessel 5 or a demister. In the event that contaminants less dense than the supercritical fluid are precipitated, they may be periodically or continuously removed via recovery means 51.

While the present invention is mainly directed to removing contaminants that are soluble in the supercritical or near supercritical fluid, the convection action generated may also loosen insolubles which are not caught on separatory screen 72 and which will be removed via recovery means 55, 51 depending on their density and the natural convection stream lines.

Example 2

Figure 2:
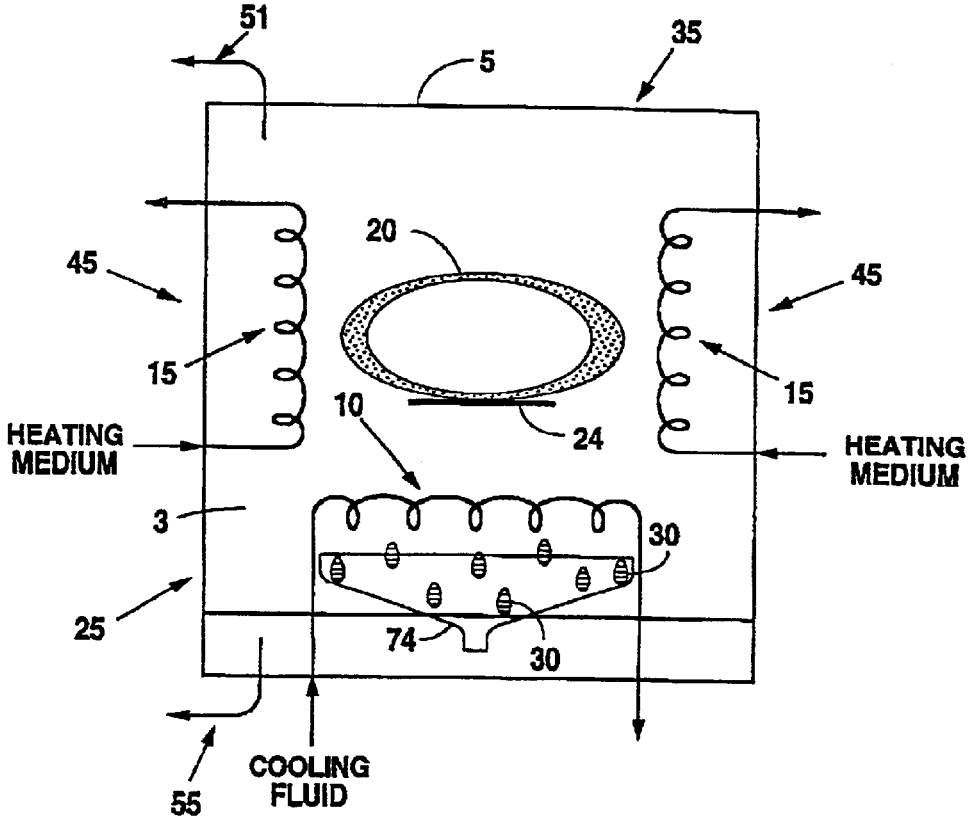
FIG. 2 schematically illustrates an alternative embodiment of the present invention with the cooling element(s) below the cleaned part and heating element(s) positioned around the part.

The apparatus of this example is shown in FIG. 2 wherein the reference numbers have the same meaning as in FIG. 1. In this example, the system is operated at a pressure of 308.05 atm (reduced pressure of 6.1). Generally for supercritical fluids at high reduced pressures, the solubility increases with increasing temperature. Since solubilities are generally much greater at the higher pressures, such higher pressures could be utilized for a gross cleaning setup and then a lower pressure such as shown in FIG. 1 could be utilized for final polishing. A portion of excess (precipitating) naphthalene 30 is schematically illustrated as being collected with a separatory funnel 74.

Since the denser cooler supercritical ethylene (0.458 g/cc) is below the hotter lighter supercritical ethylene (0.414 g/cc), the vigorous convection illustrated in FIG. 1 will be absent. Optionally, this arrangement may be operated by maintaining the pressure substantially constant through the use of the heating means and convection generated by cycling the cooling means on and off. The contaminants would be removed during the cooling cycle. At this pressure, the solubility of naphthalene in ethylene in the 44° C. hot zone and the 13° C. cool zone is 150 g naphthalene/liter ethylene and 22 g naphthalene/liter ethylene, respectively.

Example 3

Figure 3:
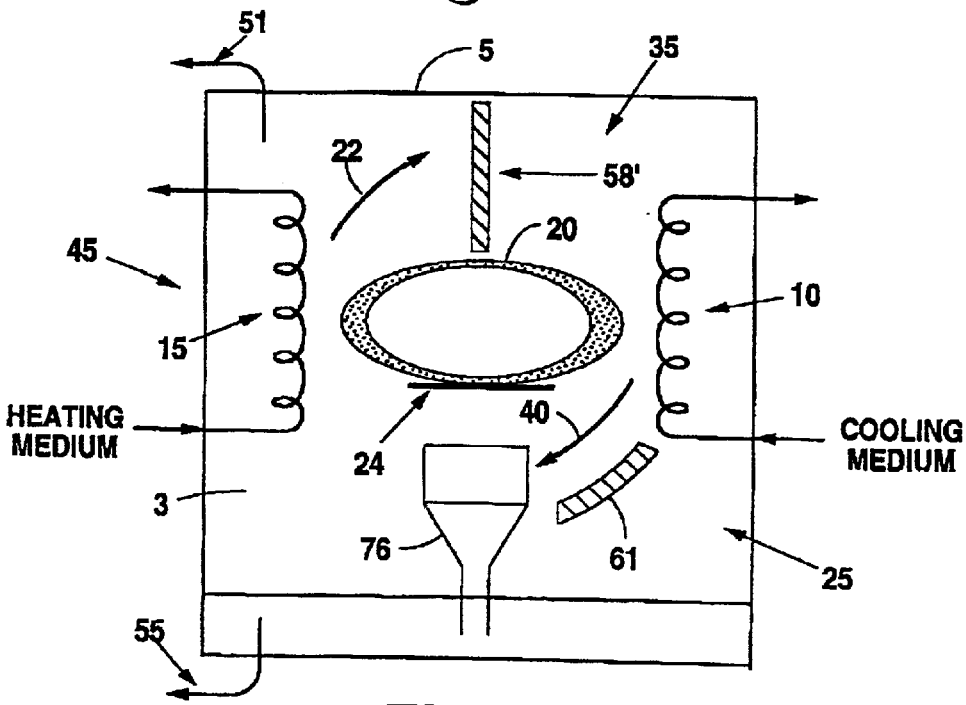
FIG. 3 schematically illustrates another alternative embodiment of the present invention with cooling element (s) to one side of the cleaned part and heating element(s) positioned on the other side of the cleaned part.
Figure 4:
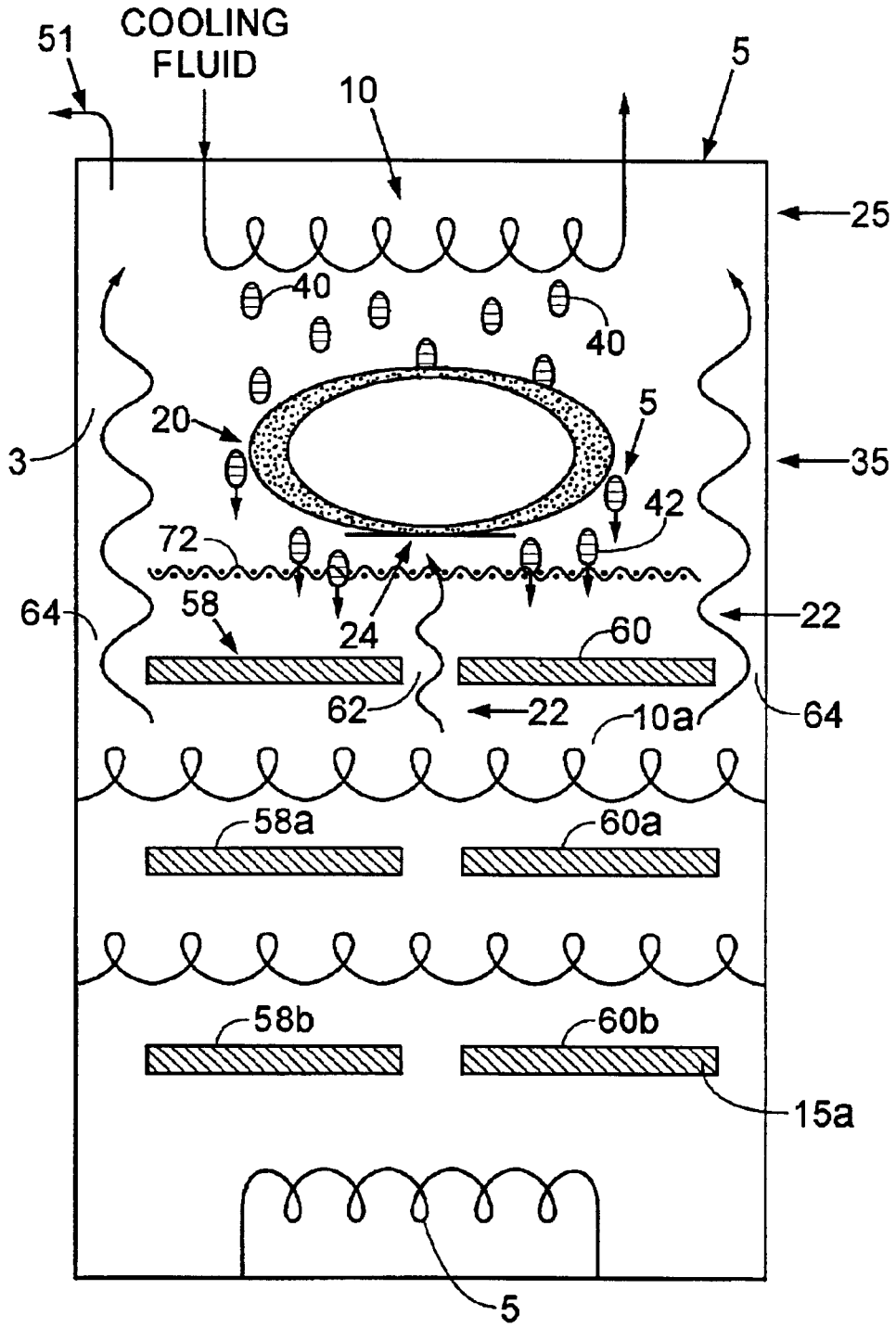
FIG. 4 schematically illustrates another alternative embodiment of the present invention with a second heating element 10*b* and a second cooling element 10*a*.

The apparatus of this example is shown in FIG. 3 wherein the reference numbers are the same as in FIG. 1. As can been seen in this example, the convective flows 22 and 40 will create a clockwise pattern around part 20, employing the insulated baffle means 58 to maintain a desired temperature difference between zones in the fluid 3. Thus the fluid flow pattern differs from the up and down movement schematically illustrated in FIG. 1 (of course, a counter clockwise pattern may be created by reversing the positions of heating means 15 and cooling means 10). When operating in the pressure regions where the solubility increases with increasing temperature it is desirable to position part 20 near or in stream 22. When operating in the pressure regions where the solubility decreases with increasing temperature it is desirable to position part 20 near or in stream 40. This example is at a reduced pressure of 6.1. In this example, heating means 15 heats the fluid causing it to rise as shown by arrow 22. The ethylene fluid is heated to 44° C. which as shown in Table 1 has a density of 0.414 g/cc and a solubility of 150 g naphthalene/liter ethylene. This heated fluid has the ability to readily dissolve naphthalene as it passes part 20. The naphthalene dissolved in ethylene then reaches cooling means where it is cooled to 13° C., which, as shown in Table 1 has a density of 0.458 g/cc and a solubility of 22 naphthalene/liter ethylene. Thus, cooling will cause precipitation of naphthalene in excess of the 22 g/l value. The naphthalene, having a density of 1.179 g/cc at 13° C., will have a tendency to fall to the bottom of vessel 5, but a portion of the convective fluid flow within vessel 5 will be directed by insulated (and curved) baffle means 61 toward separator 76 where naphthalene will be superconcentrated. The cooled ethylene that passes around to heating means 15 is heated to continue the cycle.

With the clockwise or counterclockwise convective flow pattern it may be necessary to adjust insulated baffle means and/or screens, funnels and/or separators to encourage concentration by separation and superconcentration in separation means, and to direct the precipitate away from part 20.

Example 4

The apparatus of this example is shown in FIG. 5. As can been seen in this example, a first portion of the fluid within the pressure vessel, described herein as ethylene fluid, is heated in a first zone 4 to 44° C. and a second portion of the fluid within the pressure vessel is cooled within at least the fourth zone 10 to 13° C. The heated portion of the fluid is separated from the cooled portion of the fluid using one or more insulated baffle(s) 12*a, b, c* within the pressure vessel for maintaining at least one temperature difference between zones in the fluid to facilitate convective fluid flow within the pressure vessel, and to decrease the density of the fluid such that the density change will cause the heated fluid to flow past the article toward the cooling zone. A first insulated baffle 12*a* directs at least a portion of the convective fluid flow 34*a* along an annular passage adjacent to the outer wall of the pressure vessel from a first zone 4 to a second zone 6 comprising a second heating means. The fluid in the second zone 6 is heated to approximately 34° C. and a second insulated baffle 12*b* directs at least a portion of the convective fluid flow 34*b* along an annular passage adjacent to the outer wall of the pressure vessel from the second zone 6 toward a third zone 8 containing the article to be cleaned 44. The convective fluid flow 34*b* encounters a third heating element and flows toward a fourth zone 10 containing a cooling element 42. At a substantially constant pressure of 60 atm, the solubility of the fluid with respect to the contaminant (described herein as naphthalene) is increased by cooling in the fourth zone 10 to 7.1 g naphthalene/liter ethylene increasing its density to 0.305 g/cc. Preferably, the third baffle has a substantially concave surface adjacent to the gap in the fourth zone 10 in order to direct fluid stream lines from the fourth zone 10 for the cooled fluid "burping" back into the third zone 8 along a path 60 and is directed onto the article to be cleaned 44. The pressure buildup and burping action creates a relatively high velocity cooled stream which readily solubilizes contaminant on the article to be cleaned 44 to 7.1 g naphthalene/liter ethylene. A cooling element 40 continues to cool the stream and to draw the contaminant containing stream 34*c* downward through heated second zone 6 and first zone 4. Once the contaminant solubilized fluid 34*e* is heated to a second supercritical or near supercritical temperature to reduce the solubility of the contaminant in the fluid and to precipitate at least a portion of the solubilized contaminant, the precipitated contaminant flows to a recovery element 54.

Persons of ordinary skill in the art will recognize that many modifications may be made to the present invention without departing from the spirit and scope of the present invention. The embodiment described herein is meant to be illustrative only and should not be taken as limiting the invention, which is defined in the following claims.

What is claimed is:

1. An apparatus for removing contaminants from an article to be cleaned in a pressure vessel comprising;

a first zone and a second zone separated by a first thermally insulated baffle, said first zone comprising at least a first heating element adapted to direct a fluid from said first zone to a second zone;

a third zone separated from said second zone by a second thermally insulated baffle, said second zone comprising at least a second heating element adapted to direct said fluid from said second zone to said third zone;

said third zone being separated from a fourth zone by a third thermally insulated baffle, said third zone being adapted to retain said article to be cleaned and comprising at least a third heating element adapted to direct said fluid from said third zone to said fourth zone, said third zone further comprising at least one cooling element and at least a first static baffle adapted to divert at least a portion of said fluid being directed from said fourth zone onto said article to be cleaned, producing a natural convective fluid flow at a rate effective to remove contaminants from said article to be cleaned.

2. The apparatus of claim 1 wherein said first zone is adapted to recover contaminant removed from said article cleaned.

3. The apparatus of claim 2 wherein said third zone further comprises a second static baffle adapted to direct said fourth fluid flow into said second zone.

4. The apparatus of claim 3 wherein said fluid is selected from the group consisting of a supercritical fluid and a near supercritical fluid.

5. The apparatus of claim 4 wherein said second zone is positioned gravitationally above said first zone;

said third zone is positioned gravitationally above said second zone; and, said fourth zone is positioned gravitationally above said third zone.

6. The apparatus of claim 3 wherein said second zone is positioned gravitationally above said first zone;

said third zone is positioned gravitationally above said second zone; and, said fourth zone is positioned gravitationally above said third zone.

7. The apparatus of claim 3 further comprising means for separating precipitate from said fluid.

8. The apparatus of claim 2 wherein said fluid is selected from the group consisting of a supercritical fluid and a near supercritical fluid.

9. The apparatus of claim 8 wherein said second zone is positioned gravitationally above said first zone;

said third zone is positioned gravitationally above said second zone; and, said fourth zone is positioned gravitationally above said third zone.

10. The apparatus of claim 2 wherein said second zone is positioned gravitationally above said first zone;

said third zone is positioned gravitationally above said second zone; and, said fourth zone is positioned gravitationally above said third zone.

11. The apparatus of claim 2 further comprising means for separating precipitate from said fluid.

12. The apparatus of claim 1 wherein said third zone further comprises a second static baffle adapted to direct fluid flowing from said article to be cleaned into said second zone.

13. The apparatus of claim 12 wherein said third zone further comprises a second static baffle adapted to direct said fourth fluid flow into said second zone.

14. The apparatus of claim 13 wherein said fluid is selected from the group consisting of a supercritical fluid and a near supercritical fluid.

15. The apparatus of claim 14 wherein said second zone is positioned gravitationally above said first zone;

said third zone is positioned gravitationally above said second zone; and, said fourth zone is positioned gravitationally above said third zone.

16. The apparatus of claim 13 wherein said second zone is positioned gravitationally above said first zone;

said third zone is positioned gravitationally above said second zone; and, said fourth zone is positioned gravitationally above said third zone.

17. The apparatus of claim 13 further comprising means for separating precipitate from said fluid.

18. The apparatus of claim 12 wherein said fluid is selected from the group consisting of a supercritical fluid and a near supercritical fluid.

19. The apparatus of claim 18 wherein said second zone is positioned gravitationally above said first zone;

said third zone is positioned gravitationally above said second zone; and, said fourth zone is positioned gravitationally above said third zone.

20. The apparatus of claim 12 further comprising means for separating precipitate from said fluid.

21. The apparatus of claim 1 wherein said third zone is adapted to separate precipitate from said fluid.

22. The apparatus of claim 21 wherein said third zone further comprises a second static baffle adapted to direct said fourth fluid flow into said second zone.

23. The apparatus of claim 22 wherein said fluid is selected from the group consisting of a supercritical fluid and a near supercritical fluid.

24. The apparatus of claim 23 wherein said second zone is positioned gravitationally above said first zone;

said third zone is positioned gravitationally above said second zone; and, said fourth zone is positioned gravitationally above said third zone.

25. The apparatus of claim 24 further comprising means for separating precipitate from said fluid.

26. The apparatus of claim 23 further comprising means for separating precipitate from said fluid.

27. The apparatus of claim 22 wherein said second zone is positioned gravitationally above said first zone;

said third zone is positioned gravitationally above said second zone; and, said fourth zone is positioned gravitationally above said third zone.

28. The apparatus of claim 27 further comprising means for separating precipitate from said fluid.

29. The apparatus of claim 22 wherein said third zone comprises means for separating precipitate from said fluid.

30. The apparatus of claim 21 wherein said fluid is selected from the group consisting of a supercritical fluid and a near supercritical fluid.

31. The apparatus of claim 30 wherein said second zone is positioned gravitationally above said first zone;

said third zone is positioned gravitationally above said second zone; and, said fourth zone is positioned gravitationally above said third zone.

32. The apparatus of claim 21 wherein said second zone is positioned gravitationally above said first zone;

said third zone is positioned gravitationally above said second zone; and, said fourth zone is positioned gravitationally above said third zone.

33. The apparatus of claim 21 wherein said third zone comprises means for separating precipitate from said fluid.

34. The apparatus of claim 1 wherein said fluid is selected from the group consisting of a supercritical fluid and a near supercritical fluid.

35. The apparatus of claim 34 wherein said second zone is positioned gravitationally above said first zone;

said third zone is positioned gravitationally above said second zone; and, said fourth zone is positioned gravitationally above said third zone.

36. The apparatus of claim 34 further comprising means for separating precipitate from said fluid.

37. The apparatus of claim 1 further comprising means for separating precipitate from said fluid.

38. The apparatus of claim 1 further comprising one or more additional zones separated by additional thermal insulating baffles and comprising at least an additional heating or cooling element adapted to produce a natural convective fluid flow at a rate effective to remove contaminants from said article to be cleaned.

39. An apparatus for removing contaminants from an article to be cleaned in a pressure vessel comprising;

a first zone and a second zone separated by a first thermally insulated baffle, said second zone positioned gravitationally upward from said first zone, said first zone comprising at least a first heating element adapted to direct a fluid from said first zone to a second zone;

a third zone separated from said second zone by a second thermally insulated baffle, said third zone positioned gravitationally upward from said second zone, said second zone comprising at least a second heating element adapted to direct said fluid from said second zone to said third zone;

said third zone being separated from a fourth zone by a third thermally insulated baffle, said fourth zone positioned gravitationally upward from said third zone, said third zone being adapted to retain said article to be cleaned and comprising at least a third heating element adapted to direct said fluid from said third zone to said fourth zone, said third zone further comprising at least one cooling element and at least a first static baffle adapted to divert at least a portion of said fluid being directed to said fourth zone onto said article to be cleaned, producing a natural convective fluid flow at a rate effective to remove contaminants from said article to be cleaned.

40. The apparatus of claim 39 further comprising means for separating precipitate from said fluid.

41. An apparatus for removing contaminants from an article to be cleaned in a pressure vessel comprising;

a first zone and a second zone separated by a first thermally insulated baffle, said second zone positioned gravitationally upward from said first zone, said first zone comprising at least a first heating element adapted to direct a fluid from said first zone to a second zone;

a third zone separated from said second zone by a second thermally insulated baffle, said third zone positioned gravitationally upward from said second zone, said second zone comprising at least a second heating element adapted to direct said fluid from said second zone to said third zone;

said third zone being separated from a fourth zone by a third thermally insulated baffle, said fourth zone positioned gravitationally upward from said third zone, said third zone being adapted to retain said article to be cleaned and comprising at least a third heating element adapted to direct said fluid from said third zone to said fourth zone, said third zone further comprising at least one cooling element and at least a first static baffle adapted to divert at least a portion of said fluid being directed to said fourth zone onto said article to be cleaned, producing a natural convective fluid flow at a rate effective to remove contaminants from said article to be cleaned, said third zone further comprising a second static baffle adapted to direct fluid flowing from said article to be cleaned into said second zone.

* * * * *